US010913899B2

(12) United States Patent
Samman

(10) Patent No.: US 10,913,899 B2
(45) Date of Patent: Feb. 9, 2021

(54) BOTTOM DE-HEADING DEVICE AND INLET FOR COKE DRUM

(71) Applicant: Houston Engineering Solutions, LLC, Houston, TX (US)

(72) Inventor: Mahmod Samman, Houston, TX (US)

(73) Assignee: Houston Engineering Solutions, LLC, Houston, TX (US)

( * ) Notice: Subject to any disclaimer, the term of this patent is extended or adjusted under 35 U.S.C. 154(b) by 0 days.

(21) Appl. No.: 16/405,630

(22) Filed: May 7, 2019

(65) Prior Publication Data

US 2020/0255742 A1 Aug. 13, 2020

Related U.S. Application Data

(60) Provisional application No. 62/804,344, filed on Feb. 12, 2019, provisional application No. 62/804,015, filed on Feb. 11, 2019.

(51) Int. Cl.

| | |
|---|---|
| ***C10B 25/10*** | (2006.01) |
| ***C10B 55/00*** | (2006.01) |
| ***C10B 31/00*** | (2006.01) |
| ***C10B 33/00*** | (2006.01) |

(52) U.S. Cl.

CPC ..... *C10B 25/10* (2013.01); *C10B 31/00* (2013.01); *C10B 33/00* (2013.01); *C10B 55/00* (2013.01)

(58) Field of Classification Search

CPC ..... C10B 25/10; C10B 55/00–10

See application file for complete search history.

(56) References Cited

U.S. PATENT DOCUMENTS

| | | | | |
|---|---|---|---|---|
| 4,253,487 | A | 3/1981 | Worley et al. | |
| 4,960,358 | A * | 10/1990 | DiGiacomo | C10B 25/10 202/241 |
| 5,816,787 | A | 10/1998 | Brinkerhoff et al. | |
| 6,565,714 | B2 | 5/2003 | Lah | |
| 6,660,131 | B2 | 12/2003 | Lah | |
| 6,843,889 | B2 | 1/2005 | Lah et al. | |

(Continued)

FOREIGN PATENT DOCUMENTS

WO 200438316 A2 5/2004

OTHER PUBLICATIONS

International Search Report and Written Opinion dated May 2, 2020 for Application No. PCT/US2019/065431.

*Primary Examiner* — Jonathan Luke Pilcher

(74) *Attorney, Agent, or Firm* — Patterson + Sheridan, LLP

(57) ABSTRACT

In an embodiment, a de-heading device for a coke drum includes an outer component that includes an inlet nozzle; and an inner component that includes a pipe elbow and an orifice, wherein the outer component is coupled to the inner component by an actuator, the actuator for shifting between two or more positions. In another embodiment, a method of de-heading a coke drum includes actuating an actuator, the actuator coupled to a de-heading device, wherein the de-heading device includes an outer component comprising an inlet nozzle; and an inner component comprising a pipe elbow and an orifice, wherein the outer component is coupled to the inner component by the actuator, the actuator for shifting between two or more positions; and either removing a material from a coke drum coupled to the de-heading device, or filling a coke drum coupled to the de-heading device with a material.

20 Claims, 10 Drawing Sheets

(56) References Cited

U.S. PATENT DOCUMENTS

| | | | | |
|---|---|---|---|---|
| 6,926,807 | B2 | 8/2005 | Bosi et al. | |
| 6,964,727 | B2 | 11/2005 | Lah | |
| 6,989,081 | B2 | 1/2006 | Lah | |
| 7,033,460 | B2 | 4/2006 | Lah et al. | |
| 7,115,190 | B2 | 10/2006 | Lah | |
| 7,399,384 | B2 | 7/2008 | Lah et al. | |
| 7,736,470 | B2 | 6/2010 | Chen et al. | |
| 8,123,197 | B2 | 2/2012 | Lah et al. | |
| 8,282,074 | B2 | 10/2012 | Lah et al. | |
| 8,545,680 | B2 | 10/2013 | Lah et al. | |
| 8,679,299 | B2 | 3/2014 | Lah | |
| 8,936,701 | B2 * | 1/2015 | Lah | C10B 25/10 202/241 |
| 9,109,706 | B2 * | 8/2015 | Brzoska | F16K 3/00 |
| 2013/0032465 | A1 * | 2/2013 | Lah | F16K 3/02 202/241 |
| 2013/0199967 | A1 * | 8/2013 | Brzoska | F16K 3/00 208/131 |
| 2014/0097268 | A1 | 4/2014 | Lah et al. | |
| 2017/0362510 | A1 | 12/2017 | Lah et al. | |
| 2018/0071654 | A1 | 3/2018 | Jackson | |

* cited by examiner

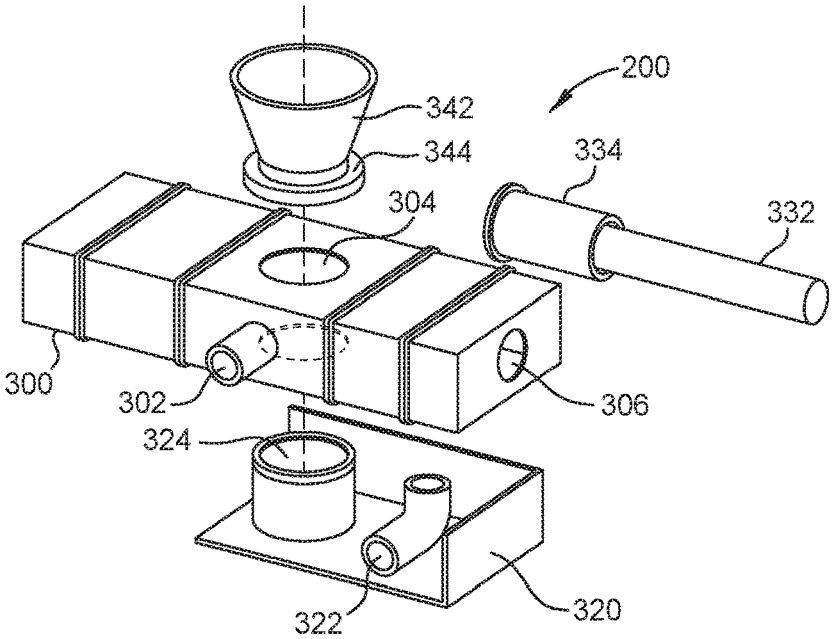
FIG. 3D
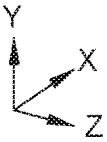
FIG. 4A
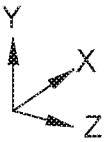
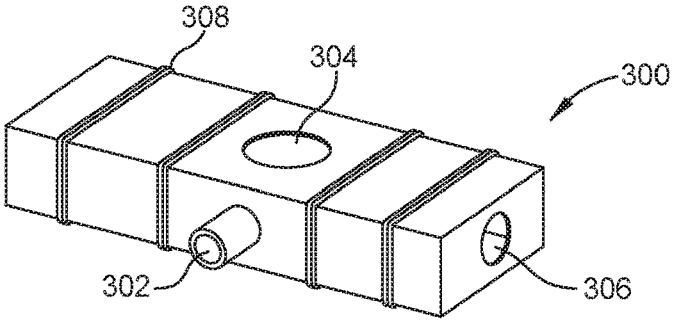
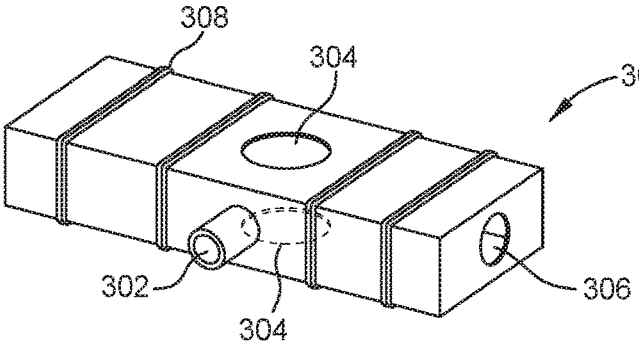
FIG. 4B
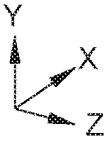
FIG. 4C
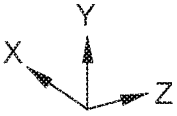
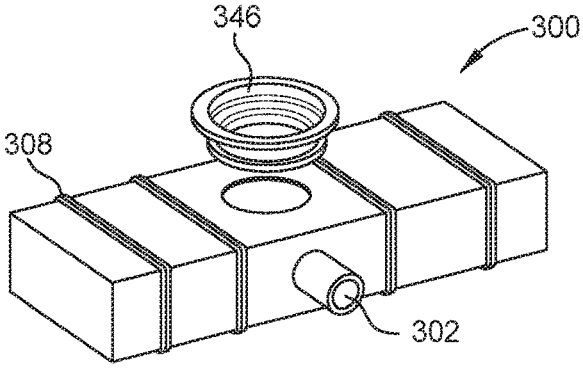

FIG. 6H
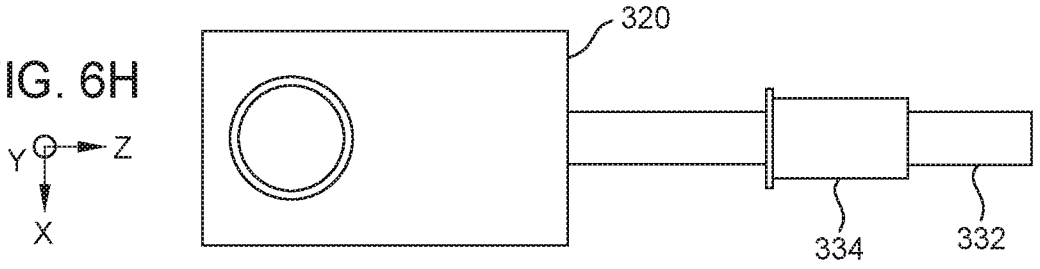
FIG. 6I
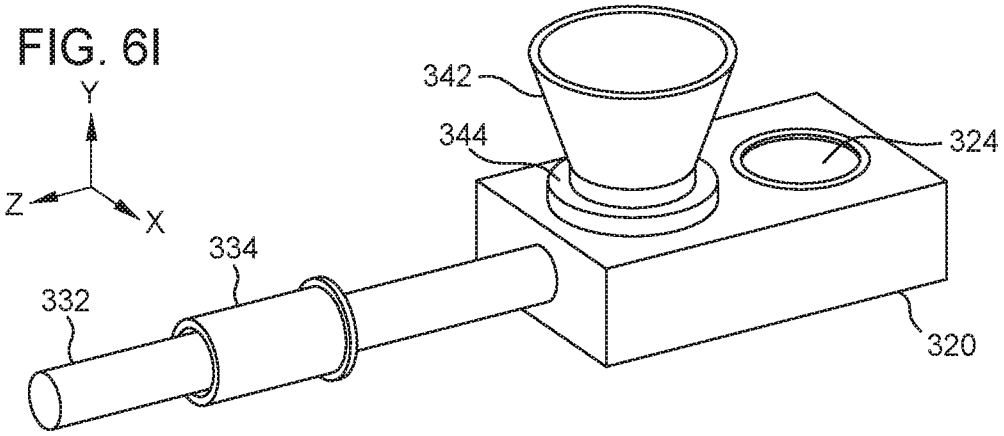
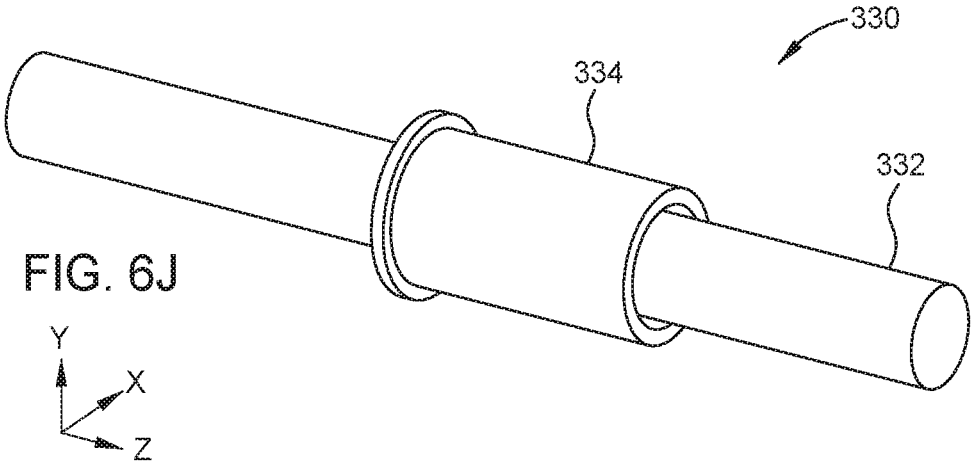
FIG. 6J

FIG. 7I
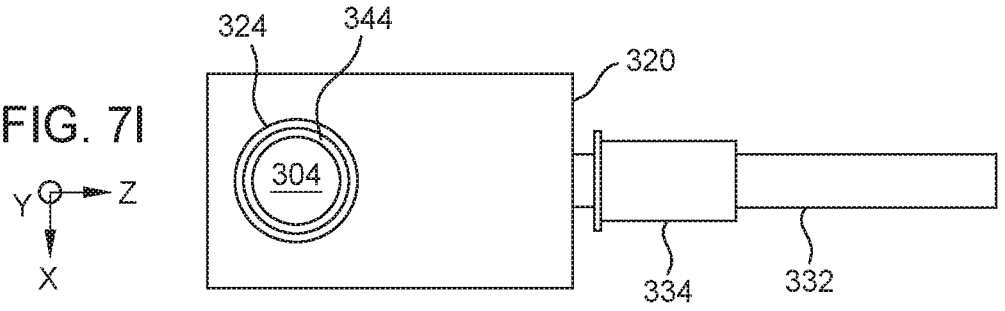
FIG. 7J
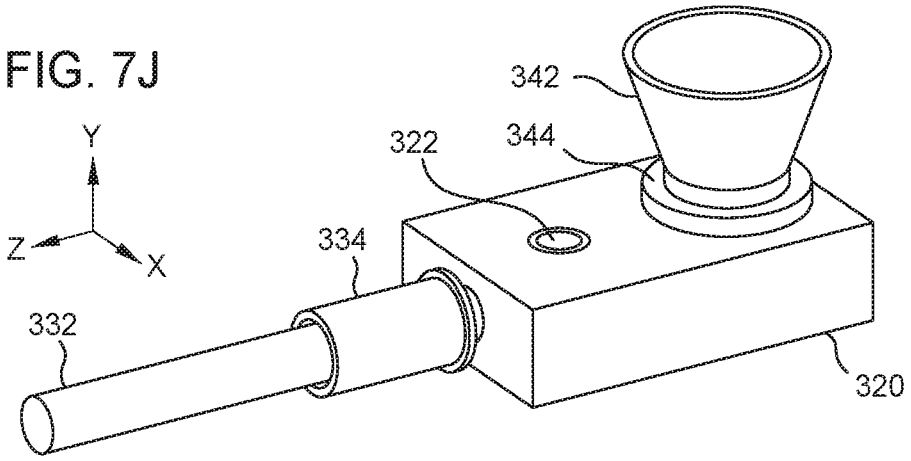
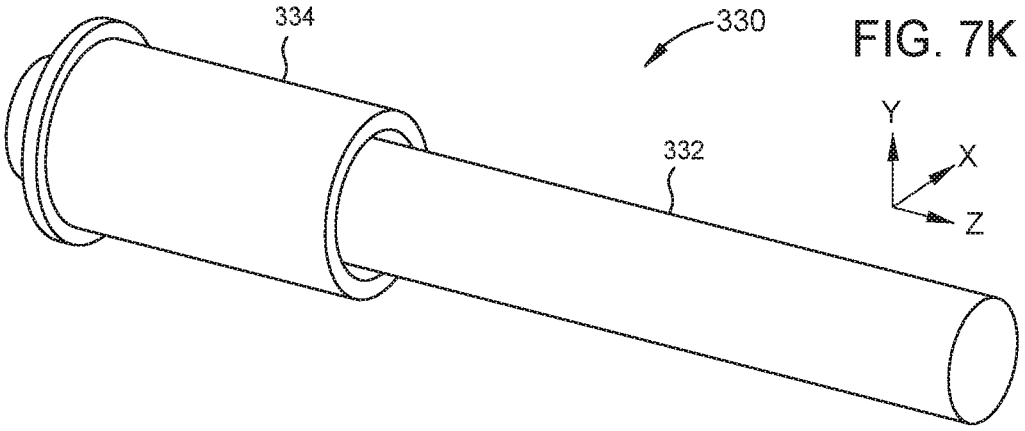
FIG. 7K

BOTTOM DE-HEADING DEVICE AND INLET FOR COKE DRUM

CROSS REFERENCE TO RELATED APPLICATIONS

This application claims benefit of U.S. Provisional Patent Application Ser. Nos. 62/804,015, filed on Feb. 11, 2019, and 62/804,344, filed on Feb. 12, 2019, which are herein incorporated by reference in their entirety.

BACKGROUND

Embodiments of the present disclosure generally relate to a device for feeding and emptying a vessel containing various types of byproduct (such as various types of coke), distillates, and/or fluids. Specifically, the present disclosure relates to a de-heading device and feeding inlet for a coke drum.

In the petroleum industry, delayed coking is used to recover products from heavy residuum that remains after distillation processes. Delayed coking is a process in which a petroleum fraction is heated to a temperature at which it thermally decomposes to provide a solid coke product and a hydrocarbon distillate product. Conventional systems and methods of filling the drum and removing the coke product from the drum can be dangerous. In addition, more recent systems and methods that separate filling from removing can have an adverse impact on process quality, can be inefficient, and can be ineffective.

What is needed is an improved coke drum de-heading device and inlet.

SUMMARY

In an embodiment, a de-heading device for a coke drum includes an outer component that includes an inlet nozzle. The de-heading device further includes an inner component that includes a pipe elbow and an orifice, wherein the outer component is coupled to the inner component by an actuator, the actuator for shifting between two or more positions.

In another embodiment, a de-heading device for a coke drum includes an outer component that includes an inlet nozzle a top opening on a top side of the outer component, and a bottom opening on a bottom side of the outer component, wherein the top opening and the bottom opening are perpendicular to the inlet nozzle. The de-heading device further includes an inner component that includes a pipe elbow and an orifice, wherein the outer component is coupled to the inneracomponent by an actuator, the actuator for shifting between two or more positions.

In another embodiment, a method of de-heading a coke drum includes actuating an actuator, the actuator coupled to a de-heading device, wherein the de-heading device includes an outer component having an inlet nozzle; and an inner component having a pipe elbow and an orifice, wherein the outer component is coupled to the inner component by the actuator, the actuator for shifting between two or more positions. The method further includes either removing a material from a coke drum coupled to the de-heading device, or filling a coke drum coupled to the de-heading device with a material.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIGS. 3C and 3D illustrate two views showing various components of the de-heading device with a coke drum according to some embodiments.

FIGS. 4A and 4B illustrate two views (with and without sides) of the outer component of the de-heading device according to some embodiments.

FIG. 4C shows the outer component of the de-heading device with an optional size adaptor according to some embodiments.

FIGS. 6A-6J illustrate several views of the de-heading device and the various components of the de-heading device in a closed (e.g., a filling) position according to some embodiments.

FIGS. 7A-7K illustrate several views of the de-heading device and the various components of the de-heading device in an open (e.g., an emptying) position according to some embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure includes an improved bottom de-heading device for de-heading a coke drum. The de-heading device includes an inlet for feeding the coke drum. The Applicant has discovered that a single device having an outer component that includes an inlet nozzle, and an inner component that includes a pipe elbow and an orifice, wherein the outer component is coupled to the inner component by, e.g., an actuator, overcomes the disadvantages of conventional de-heading and feed inlet devices (e.g., asymmetric flow of feed, large thermal gradients, non-uniform processing, having to use multiple devices, and the retractable feed inlet device getting stuck inside the drum).

In the petroleum industry, delayed coking is used to recover products from heavy residuum that remains after distillation processes. Delayed coking is a process in which a petroleum fraction is heated to a temperature at which it thermally decomposes to provide a solid coke product and a hydrocarbon distillate product. In general, a liquid petroleum feed stock is first distilled until the lighter ends have been recovered and a heavy residuum remains. This heavy residuum of heated pitch and cat-cracked heavy or cycle oil is charged to the bottom of a structure called a coke drum.

Figure 1:
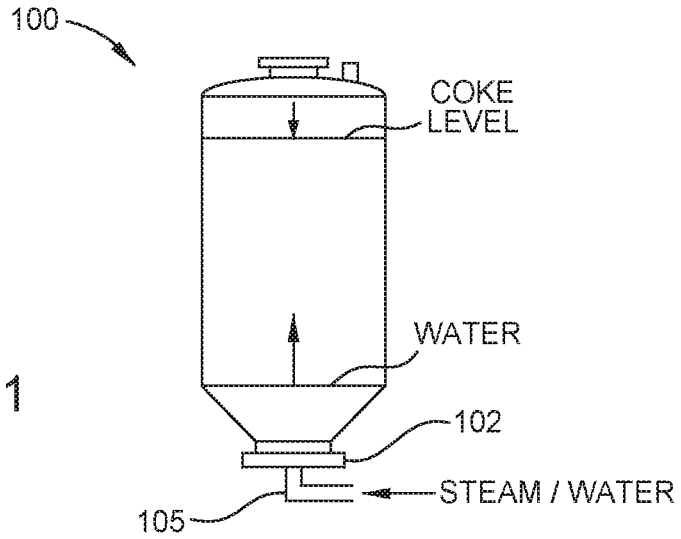
FIG. 1 shows a conventional drum being filled with water during quenching.

In the coke drum, the heavy residuum is further heated to about 900° F. and undergoes extensive and controlled cracking and coking under high-pressure conditions. A cracked lighter product rises to the top of the coke drum in a process called steam stripping and is drawn off. A heavier product remains and cracks to coke, a solid, coal-like substance. The coke is usually purged with steam to remove any remaining volatile components. After the cracking and coking process is complete, quench water is introduced and high-pressure water jets are used to cut away and remove the coke. The water reduces the temperature in the drum to around 200° F. or less before a new cycle begins. After the coke is removed, the flange is replaced and the coke drum is prepared to repeat the cycle. FIG. 1 shows a coke drum 100 being filled with water during quenching. To fill and quench the drum, a flange 102 is bolted onto the drum and an inlet nozzle 105 is used to feed water and/or steam during quenching.

The process of removing the coke from the drum can be dangerous. For example, to empty the drum after quenching, the flange through which the drum is filled during quenching (e.g., the flange 102) is unbolted and swung away to empty the drum (e.g., to de-head the drum). During such a process, operating personnel can be exposed to hot steam, hot water, flammable hydrocarbons, coke particles, and noxious gases.

Conventional devices for de-heading the coke drum include swing-away mechanisms and remotely-operated fully enclosed valves. Swing-away mechanisms remotely de-head the drum by swinging the bottom flange away from the drum. The mechanism allowed operators to be located farther from the bottom head but did not eliminate the possibility of injury and/or fire during the de-heading process. This incremental improvement was used on a very limited scale. The remotely-operated fully enclosed valves separated the inlet nozzle from the bottom flange. One example of this fully enclosed valve uses a sliding valve that uses a plate with a circular opening to enable emptying the drum. Another example of the fully enclosed valve uses a sliding valve that uses a double disc that provides better sealing and less steam leaks.

To use either of these two fully enclosed valves, a separate inlet is required to feed the drum which was commonly performed by adding a spool with a single-side inlet immediately above the valve. However, use of the single-side inlet causes flow into the drum to be asymmetric which results in excessive thermal gradients that damage the drum causing it to tilt, crack, and bulge. Use of the single-side inlet also causes non-uniform processing of petroleum coke which results in hot spots and blowouts. Some operators used two opposing inlets to feed the drum which is better for producing a more symmetric flow but worse in potentially causing higher flange stresses.

Conventional devices to help alleviate the asymmetric flow problem include retractable center feed devices in which a telescopic shaft enters the drum to allow filling and retracts out to allow emptying the drum. However, this device can get stuck or fail when operating inside a body of hot, gummy, and flammable material. Such sticking and/or failure involves significant costs associated with, e.g., shutting down production and personnel costs for the repairs. In addition, retractable devices can be expensive and require significant and time-consuming maintenance.

None of these conventional devices provide solutions that are safe, simple, and cost effective. Therefore, what is needed is an improved coke drum de-heading device and inlet.

Various de-heading devices are disclosed in the art such as U.S. Pat. Nos. 5,816,787; 6,565,714; 6,660,131; 6,843,889; 6,926,807; 6,964,727; 6,989,081; 7,115,190; 7,033,460; 7,117,959; 7,3167,62; 7,399,384; 7,736,470; 8,123,197; 8,282,074; 8,545,680; and 8,679,299, each of which is incorporated by reference in its entirety.

In some embodiments, the de-heading device can be used for either new coke drums or retrofit coke drums.

Figure 2A:
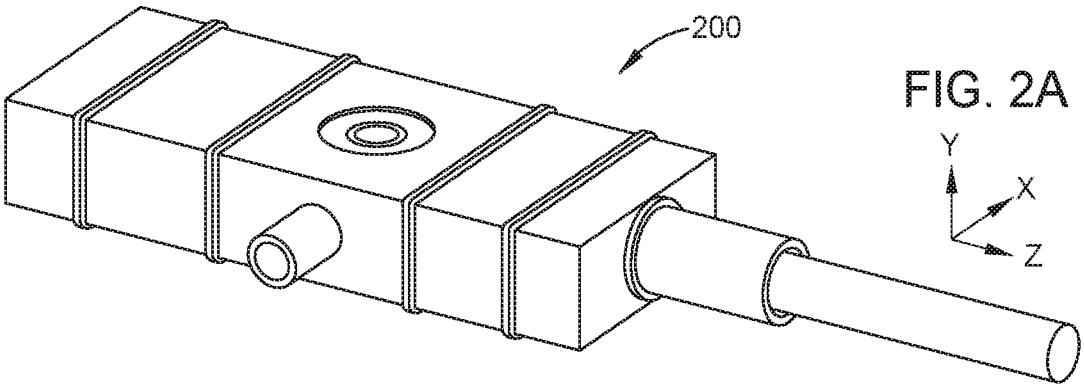
FIG. 2A shows a de-heading device in a closed (e.g., a filling) position according to some embodiments.
Figure 2B:
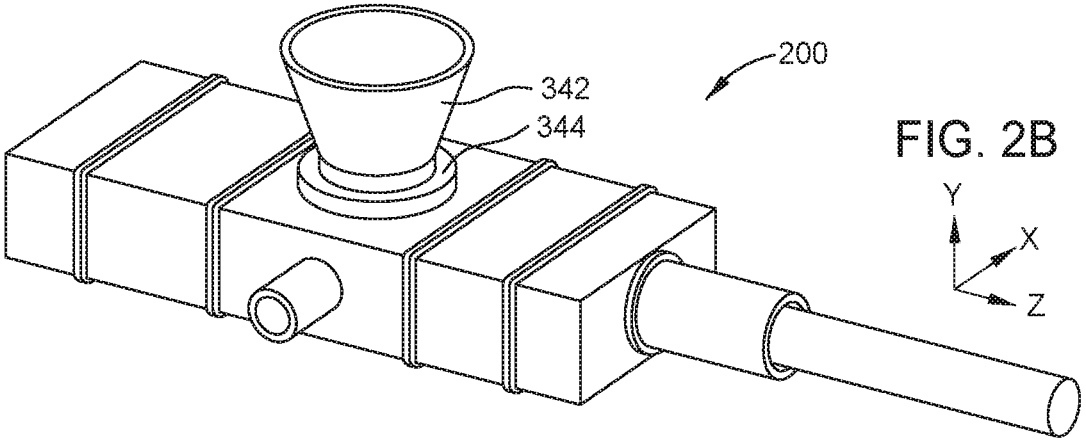
FIG. 2B shows a de-heading device with a coke drum in a closed (e.g., a filling) position according to some embodiments.
Figure 3A:
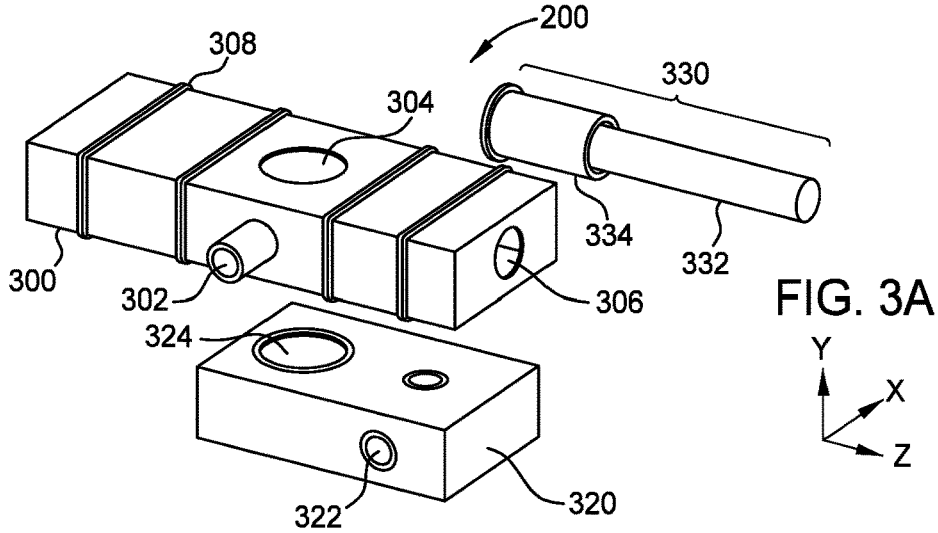
FIGS. 3A and 3B illustrate two views (with and without sides) showing various components of the de-heading device according to some embodiments.
Figure 3B:
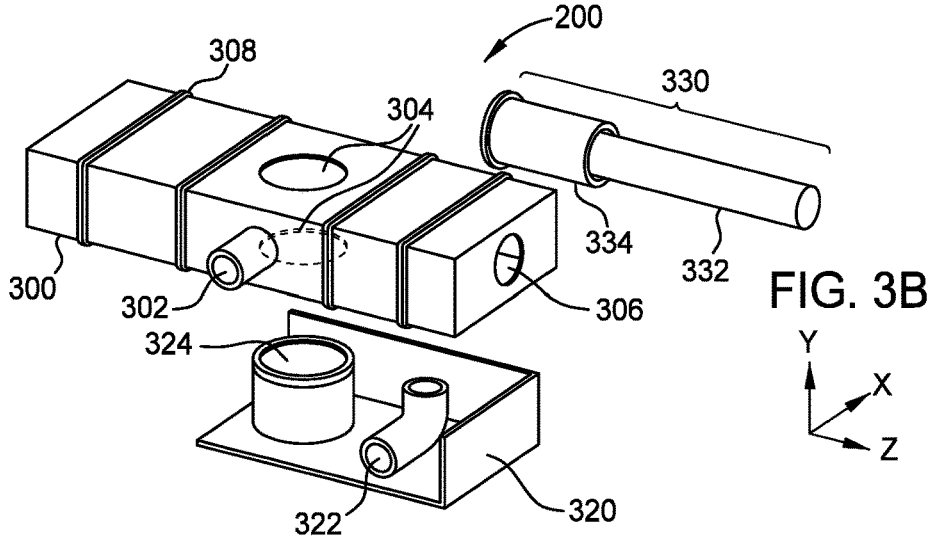
Figure 3C:
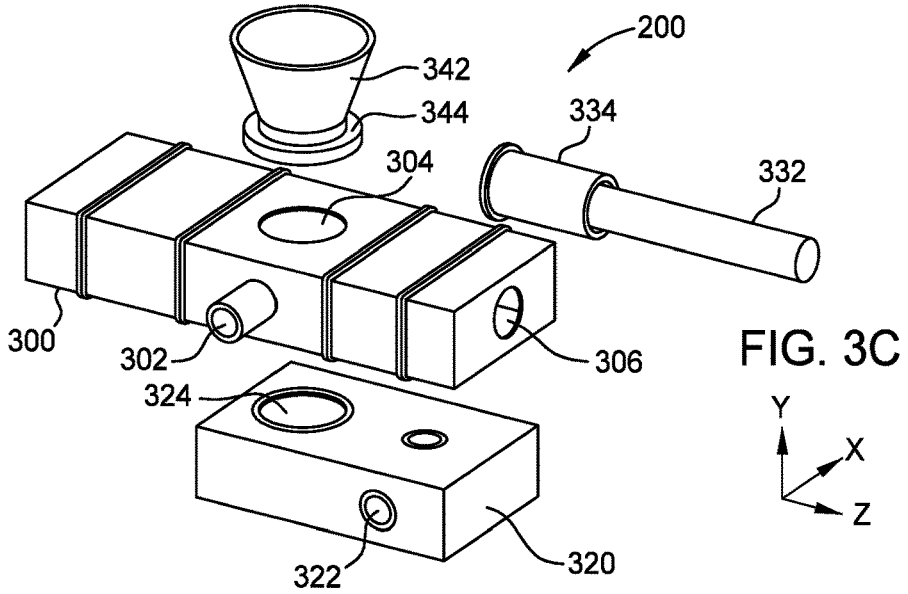

FIGS. 2A and 2B shows a de-heading device 200 in a closed (e.g., a filling) position according to some embodiments. FIG. 2A shows the de-heading device 200 without a bottom of a coke drum 342 and FIG. 2B shows the de-heading device 200 with a bottom of a coke drum 342 and flange 344. In some embodiments, and as shown in FIG. 2B, a flange 344 can be coupled to and sealed to the de-heading device 200 by any method known to a person of ordinary skill in the art, e.g., a bolted connection. In some embodiments, the flange 344 can be used to connect the outer component 300 with a vessel 342 (e.g., a coke drum, or a bottom of a coke drum such as a drum cone) by any method known to a person of ordinary skill in the art, e.g., a bolted connection. Depending on the design of the coke drum 342, the de-heading device 200 may be coupled directly to the bottom of the coke drum 342. The components of the de-heading device 200 are discussed below.

FIGS. 3A-3D illustrate several views of various components of the de-heading device 200 (including with and without a bottom of a coke drum 342) according to some embodiments (with and without sides). The de-heading device 200 includes an outer component 300 and an inner component 320. The outer component 300 and inner component 320 may be composed of one or more components and may be joined using bolting and/or welding. The movement of the de-heading device 200 can be controlled by actuating an actuator 330, and in some embodiments, the de-heading device 200 can include an actuator 330 that may be, e.g., electrical or hydraulic. In some embodiments, the actuator 330 can include a shaft 332. In some embodiments, the outer component 300 can be coupled to the inner component 320 by using an actuator 330 (e.g., a linear actuator), and a shaft 332 of the actuator 330 can drive the movement of the inner component 320. Upon actuation of the actuator 330 and the shaft 332 connected thereto, the inner component 320 can be caused to move into/out of or to slide into/out of the outer component 300. Actuation may be performed by, e.g., hydraulic or electrical methods that push/pull the inner component 320 as the inner component 320 slides into/out of or moves into/out of the outer component 300. The actuator 330 may be controlled or actuated from a remote site away from the coke drum, providing a further safety feature of the de-heading device 200 of the present disclosure.

In some embodiments, the inner component 320 can be connected to a shaft 332 (e.g., a moving shaft) of the actuator 330 and the outer component 300 can be coupled to the body 334 of the actuator 330. The inner component 320 may be connected to the shaft 332 of the actuator 330 by any method known to a person of ordinary skill in the art, e.g., a bolted connection. The outer component 300 may be connected to the body 334 of the actuator 330 by any method known to a person of ordinary skill in the art, e.g., a bolted connection. In some embodiments, one or more seals can be used to minimize leakage between various components of the de-heading device 200. For example, one or more seals can be used to minimize leakage between the inner component 320 and the outer component 300, and/or between the outer component 300 and the drum 342.

FIGS. 4A and 4B illustrate two views of the outer component 300 of the de-heading device according to some embodiments (with and without sides). The outer component 300 can be a fixed housing that can include an inlet nozzle 302 through which a feed (e.g., product, oil, water, steam) may flow into the drum. The outer component 300 can include two openings 304 located on two sides (e.g., a top side and a bottom side) of the outer component 300. The two openings 304 can serve as openings through which material (e.g., coke) can be removed from the coke drum. The two openings 304 (e.g., a top opening and a bottom opening) can be concentric circular openings. A diameter of both of the two openings 304 can be equal to or greater than a diameter of a manway of the cone 342 to which one of the openings 304 is attached. In some embodiments, at least one of the two openings 304 can serve as an attachment site for a flange. In some embodiments, the outer component 300 can include one or more stiffeners 308 that are used to strengthen the de-heading device and to minimize deflections under operating loads. The one or more stiffeners 308 may be parallel to the inlet nozzle 302 (as shown in FIG. 4A), perpendicular to the inlet nozzle 302, at any angle relative to the inlet nozzle 302, or a combination thereof.

The manway of the cone of the coke drum 342 is also known as the bottom head nozzle or dump nozzle. Typical diameters for the manway can range from about 1 meter to about 3 meters, such as about 1.5 meters to about 2.5 meters. The diameter of the two openings 304 of the outer component 300 may be the same or different. The centers of the two openings 304 of the outer component 300 can be located on the axis of the drum, and the two openings 304 and the axis of the drum can be perpendicular (or substantially perpendicular, such as from 80° to 100°) to the inlet nozzle 302. The outer component 300 can act as the structural body of the de-heading device 200 that is supposed to resist forces from operation of the de-heading device, fluid flow, and loads from a pipe that can be attached to the inlet nozzle 302. To do so, and in some embodiments, this outer component 300 can have a thick wall and/or structural stiffeners 308. The outer component 300 can include an aperture 306 (which may be a circular aperture) through which the shaft 332 of the actuator 330 can move in and out.

FIG. 4C shows the outer component 300 of the de-heading device 200 with an optional size adapter 346 according to some embodiments. The optional size adapter can, e.g., allow for a standard size valve to be used with coke drums of different manway sizes. In some embodiments, the size adapter 346 can bolt to the bottom flange 344 of a coke drum.

Figure 5A:
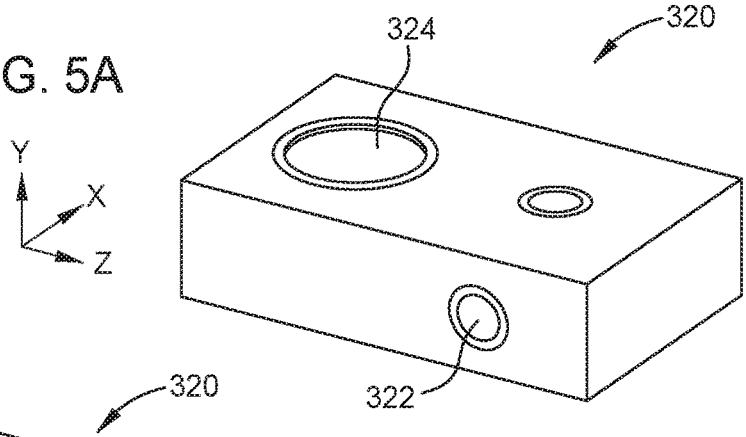
FIGS. 5A-5C illustrate several views (with and without sides) of the inner component of the de-heading device according to some embodiments.
Figure 5B:
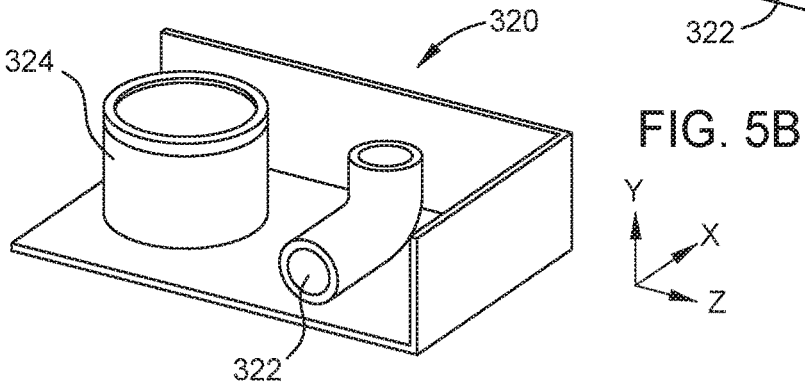
Figure 5C:
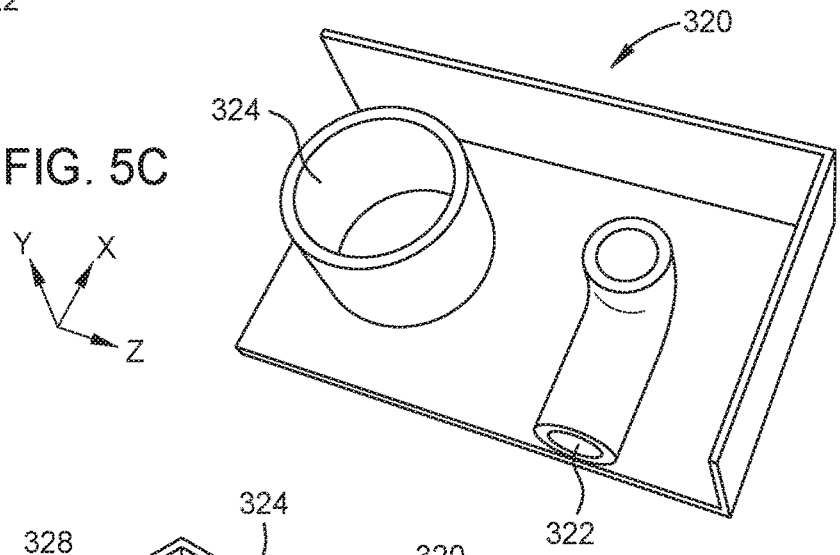

FIGS. 5A-5C illustrate several views of the inner component 320 of the de-heading device according to some embodiments (with and without sides). The inner component 320 can serve as a moving or sliding component of the de-heading device. The inner component 320 can include a pipe elbow 322 that directs a fluid flow from the side of the inner component 320 to the top of the inner component 320. The pipe elbow 322 can be a single elbow or a series of elbows at any angle, for example, 90°, 45°, and 22°, and angles greater than 90° such as 95° and 100°. The pipe elbow 322 can have two ends, a first end and a second end. The ends of the pipe elbow 322 can be socketed, machined for butt welding, or threaded. In some embodiments, the ends of the pipe elbow 322 can have a same diameter. In other embodiments, the ends of the pipe elbow can have a different diameter. Typical diameters for the ends of the pipe elbow 322 can range from about 0.3 meters to about 0.7 meters, such as about 0.4 meters to about 0.6 meters. The inner component 320 can include an orifice 324 through which a material (e.g., coke) can be removed from the coke drum. The orifice 324 can be a cylindrical orifice. In some embodiments, one end of the orifice 324 can be tapered. The orifice 324 can have a diameter that is equal to or greater than a diameter of the openings 304 of the outer component 300. Typical diameters for the orifice 324 can range from about 1 meter to about 3 meters, such as about 1.5 meters to about 2.5 meters. The exterior dimensions of the inner component 320 can be smaller than interior dimensions of the outer component 300 to allow the inner component 320 to move or slide into and out of the outer component 300. The location of the pipe elbow 322 relative to the orifice 324 can vary.

In some embodiments, the inner component 320 can have one or more of the following dimensions: a length that is from about 3 meters to about 7 meters, such as about 4 meters to about 6 meters; a width that is from about 1.5 meters to about 4 meters, such as about 2 meters to about 3.5 meters; and a height that is from about 0.4 meters to about 2.5 meters, such as about 0.5 meters to about 2 meters.

In some embodiments, the outer component 300 can have one or more of the following dimensions: a length that is from about 4 meters to about 8 meters, such as about 5 meters to about 7 meters; a width that is from about 1.7 meters to about 6 meters, such as about 2.2 meters to about 4 meters; and a height that is from about 0.5 meters to about 3 meters, such as about 0.6 meters to about 2.5 meters.

Figure 5D:
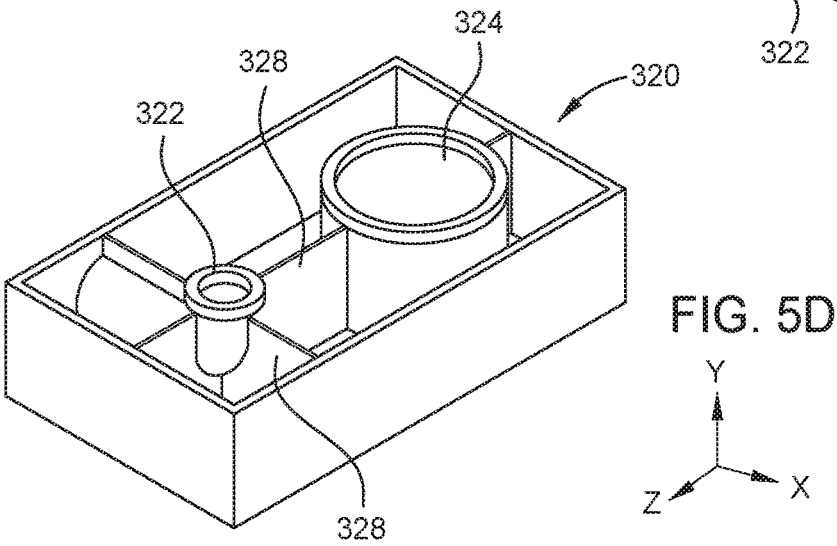
FIG. 5D shows the inner component of the de-heading device with internal gussets according to some embodiments.

FIG. 5D shows the inner component 320 of the de-heading device 200 with one or more internal gussets 328 according to some embodiments. In some embodiments, the inner component can include one or more internal gussets 328. The one or more internal gussets 328 can serve to stiffen the inner component and can serve to make the inner component rigid enough to minimize displacements and stresses during pushing and/or pulling by the actuator. The one or more internal gussets 328 can be axial, lateral, oblique (e.g., angled), or a combination thereof.

Figure 6A:
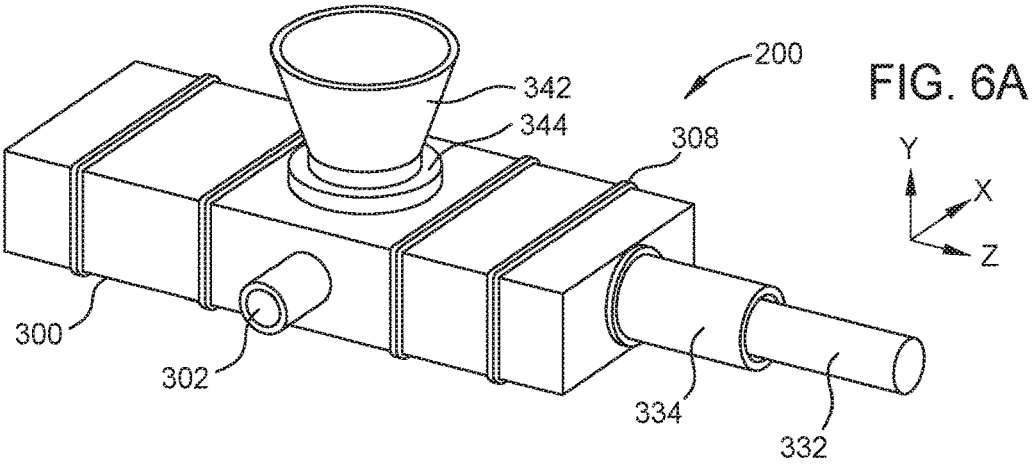
Figure 6B:
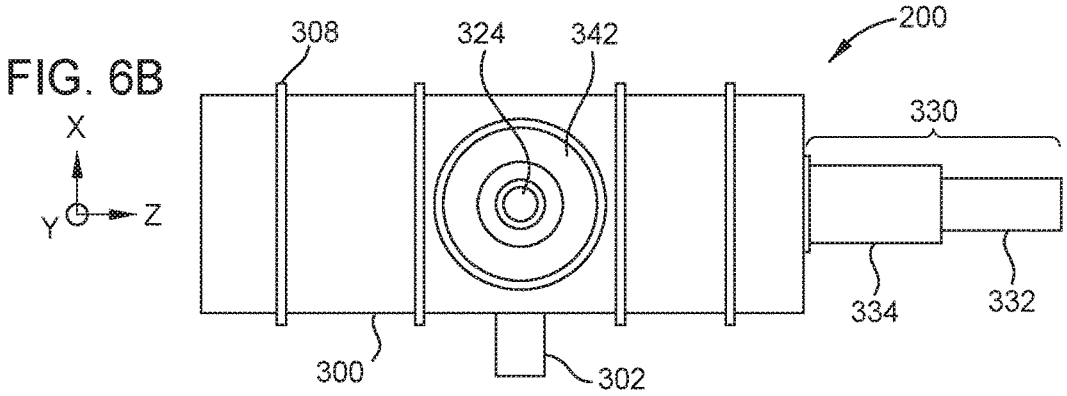
Figure 6C:
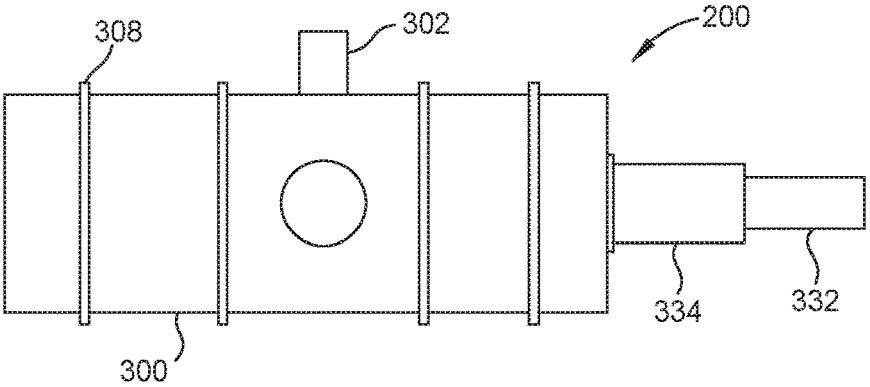
Figure 6D:
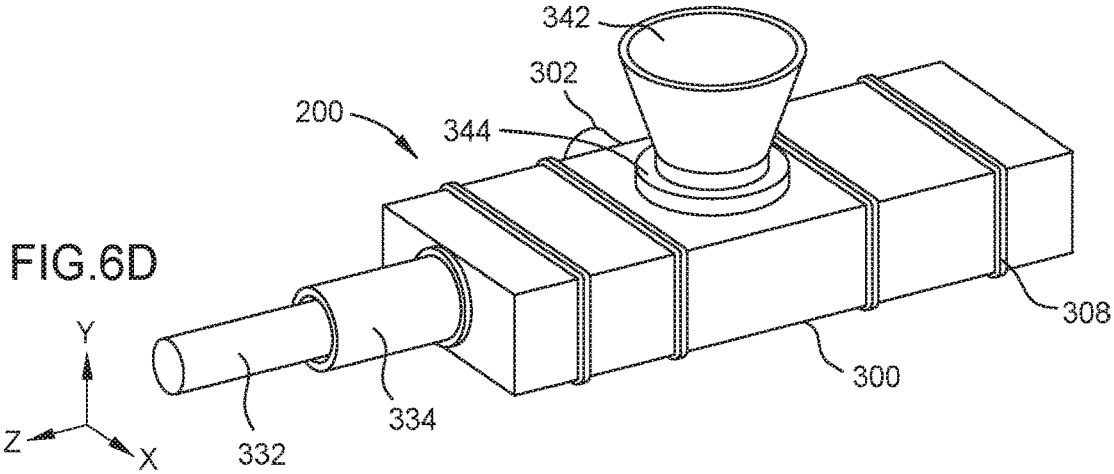
Figure 6E:
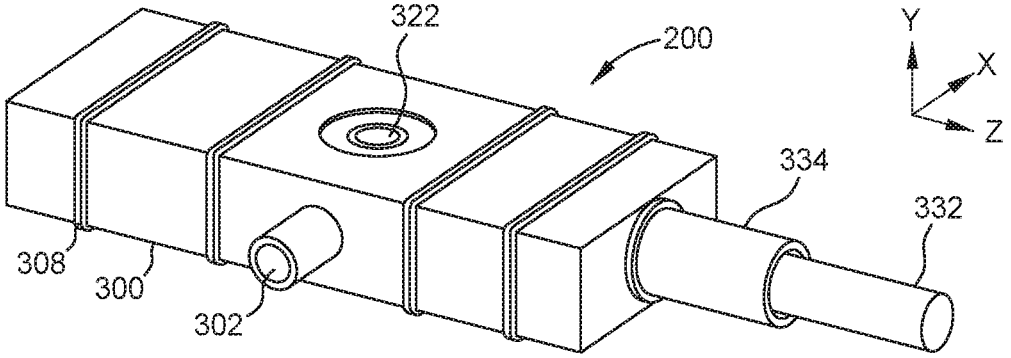
Figure 6F:
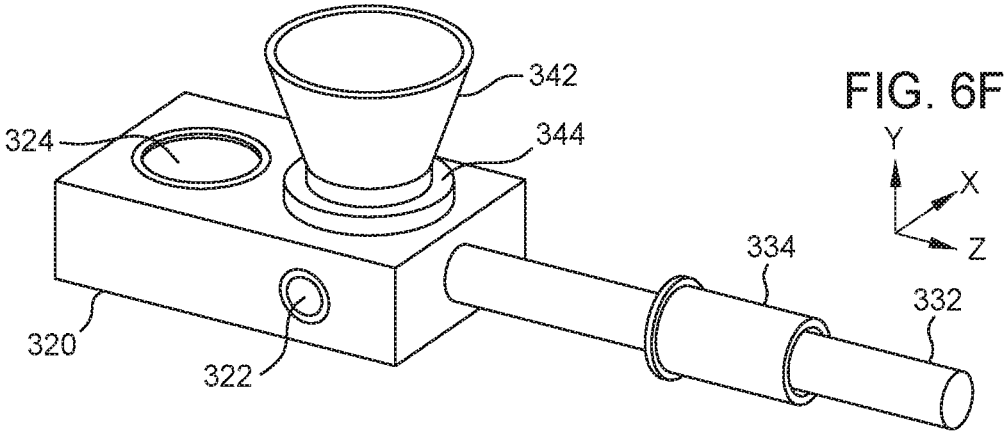
Figure 6G:
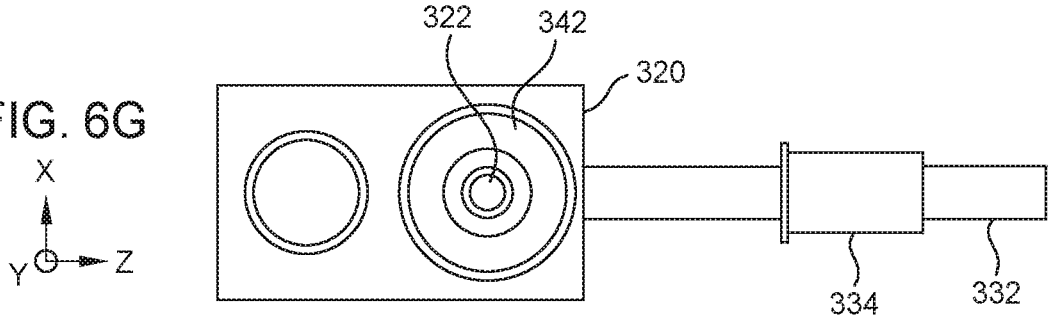
Figure 7A:
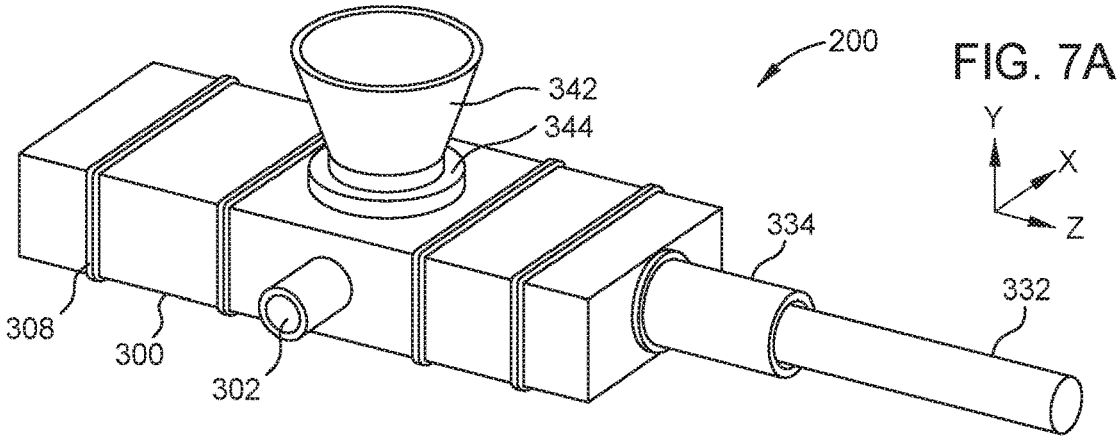
Figure 7B:
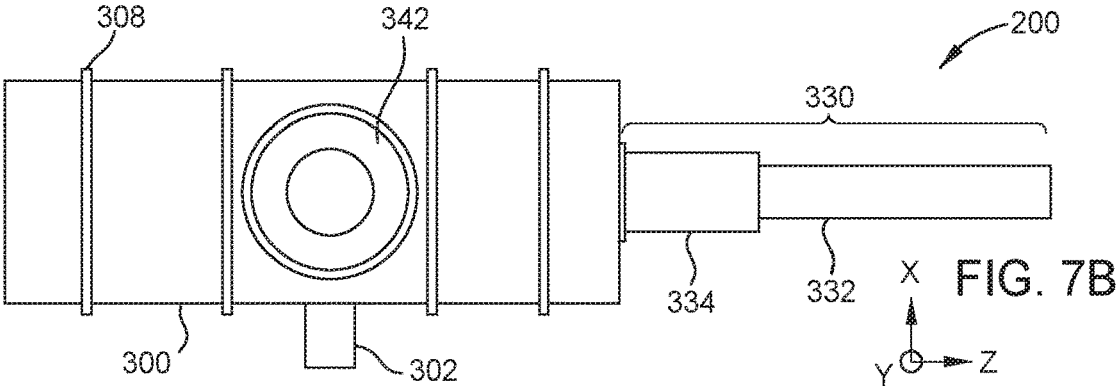
Figure 7C:
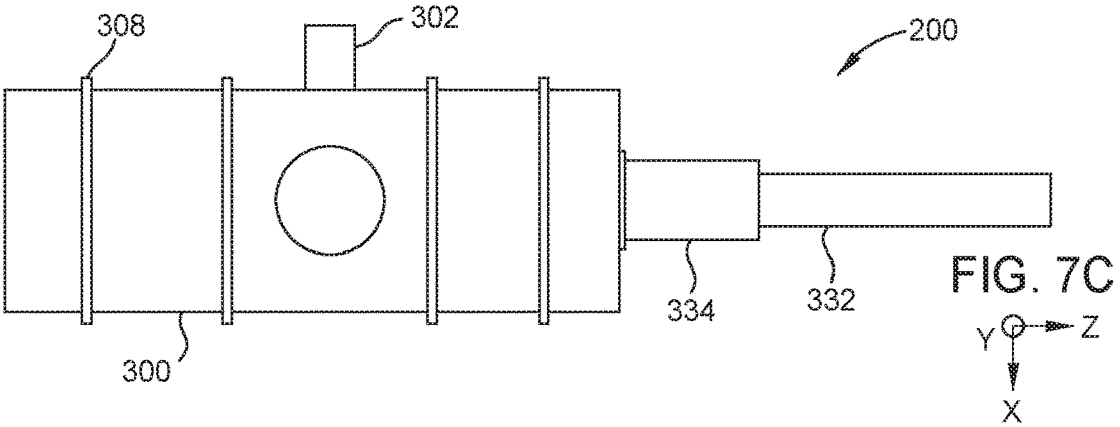
Figure 7D:
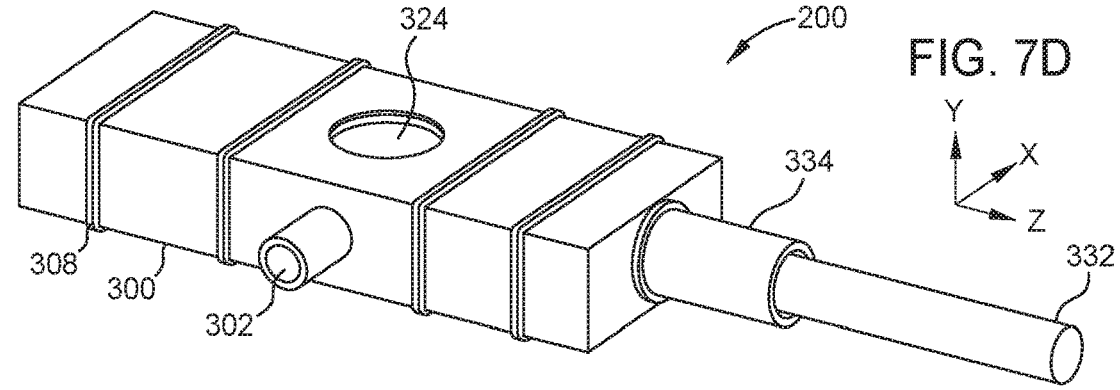
Figure 7E:
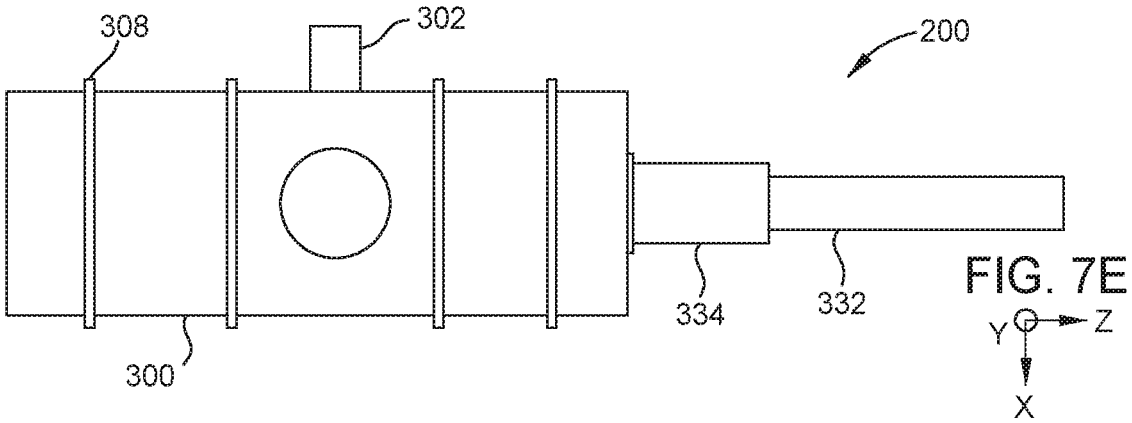
Figure 7F:
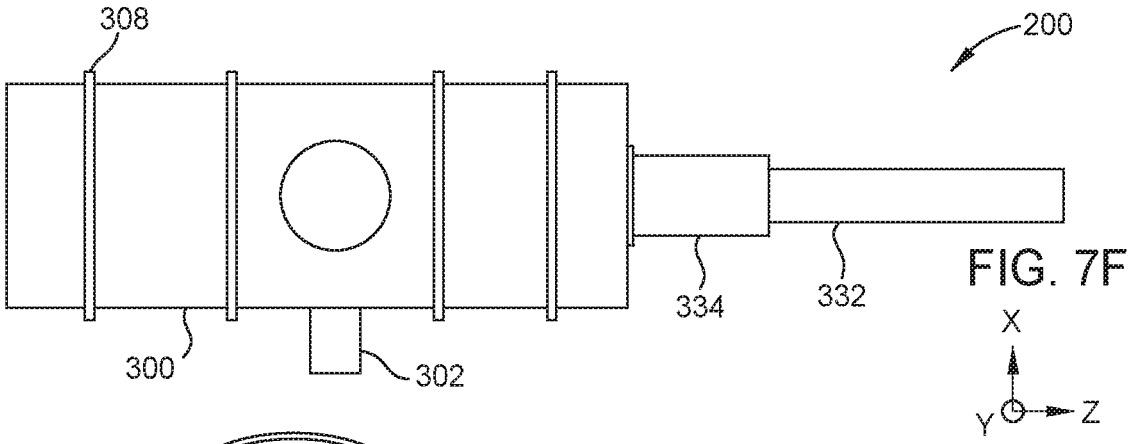
Figure 7G:
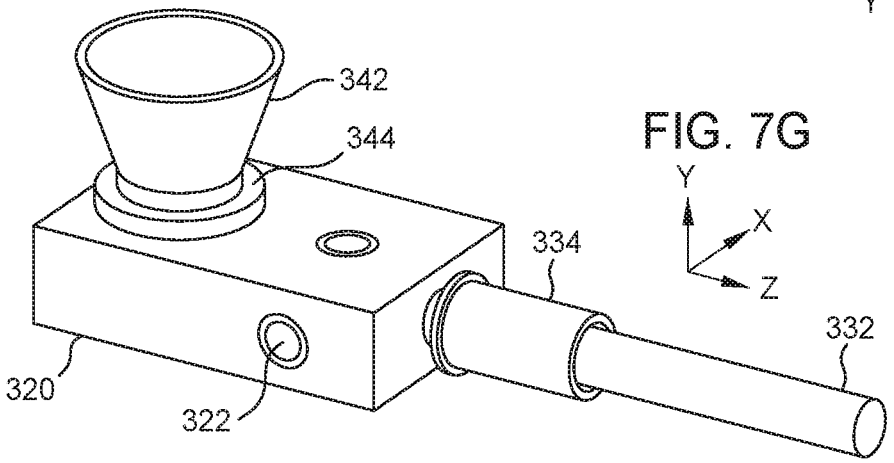
Figure 7H:
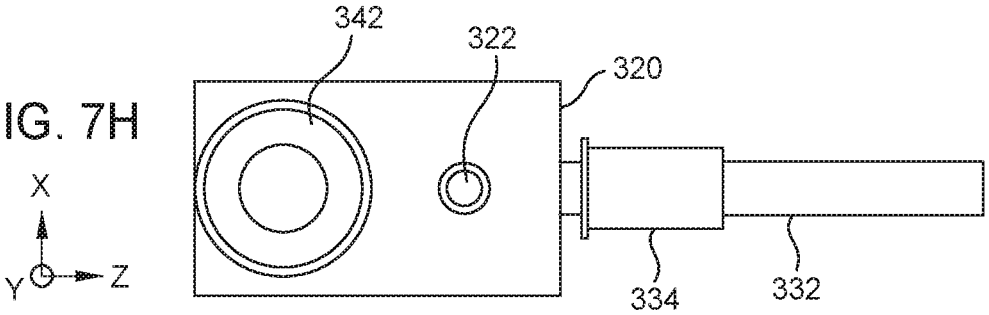

According to some embodiments, and as shown, e.g., in FIG. 6A, before operating the de-heading device 200, the outer component 300 can be coupled to a flange 344 (and/or the size adapter 346) that is coupled to the coke drum 342, such that the de-heading device 200 can be at least substantially sealed to a coke drum (the coke drum is represented by 342). The de-heading device (via, e.g., the outer component 300) and coke drum 342 can be coupled to and sealed to the flange 344 (and/or the size adapter 346) by any method known to a person of ordinary skill in the art, e.g., by a bolted connection. The de-heading device 200 can be closed and opened as needed by moving the inner component 320 back and forth.

In some embodiments, the outer component 300 and the inner component 320 may be arranged in a manner where there is selective communication between a coke drum 342 and the inlet nozzle 302 of the outer component 300. In some embodiments, the outer component 300 and the inner component 320 may be arranged in a manner where there is selective communication between a coke drum 342 and the two openings 304 of the outer component 300. In some embodiments, the outer component 300 and the inner component 320 may be arranged in a manner where there is selective communication between a coke drum 342 and the orifice 324 of the inner component 320. In some embodiments, the outer component 300 and the inner component 320 may be arranged in a manner where there is selective communication between a coke drum 342 and the pipe elbow 322 of the inner component 320.

FIGS. 6A-6J illustrate several views of the de-heading device 200 and the various components of the de-heading device 200 in a closed (e.g., a filling) position according to some embodiments. FIGS. 6F-6J illustrate several views of the de-heading device 200 without the outer component 300 in a closed (e.g., a filling) position according to some embodiments. In some embodiments, the de-heading device 200 can be coupled to and sealed to the coke drum 342 by the flange 344 (and/or the size adapter 346). In order to place the de-heading device 200 into a closed position or a partially closed position, actuation of the actuator 330 and the shaft 332 connected thereto can cause the inner component 320 to move into/out of or to slide into/out of the outer component 300 in a bi-directional manner such that the pipe elbow 322 of the inner component 320 can be positioned into substantial alignment with the inlet nozzle 302 of the outer component 300. In this position, feed (e.g., oil, steam, and/or water) can flow vertically into the coke drum 342 in a symmetric manner. The symmetric flow can be advantageous as it reduces (or eliminates) thermal gradients that damage the coke drum via, e.g., tilting, cracking, or bulging. The symmetric flow can also allow for more uniform processing of petroleum coke by reducing (or eliminating) hot spots and blowouts.

FIGS. 7A-7K illustrate several views of the de-heading device 200 and the various components of the de-heading device 200 in an open (e.g., an emptying) position according to some embodiments. FIGS. 7G-7K illustrate several views of the de-heading device 200 without the outer component 300 in an open (e.g., an emptying) position according to some embodiments. In some embodiments, the de-heading device 200 can be coupled to and sealed to the coke drum 342 by the flange 344 (and/or the size adapter 346). In order to place the de-heading device 200 into an open position or a partially open position, actuation of an actuator 330 and the shaft 332 connected thereto can cause the inner component 320 to move into/out of or to slide into/out of the outer component 300 in a bi-directional manner such that the orifice 324 of the inner component 320 can be positioned into substantial alignment with the two openings 304 of the outer component 300. In this position, material (e.g., solid petroleum coke) can be removed and/or purged from the coke drum 342 by known methods.

In some embodiments, a de-heading device for a coke drum can include an outer component having an inlet nozzle; and an inner component having a pipe elbow and an orifice, wherein the outer component is coupled to the inner component by an actuator, the actuator for shifting between two or more positions. In these or other embodiments, the outer component and inner component may be arranged in a manner where there is selective communication between a coke drum and the inlet nozzle. In some embodiments, at least one position of the two or more positions may allow (may enable) a material to be introduced into the inlet nozzle and a coke drum. In these or other embodiments, at least one position of the two or more positions may allow (may enable) a material to exit a coke drum and/or to pass through the orifice of the inner component.

In some embodiments, the outer component may further include a top opening on a top side of the outer component, and a bottom opening on a bottom side of the outer component. In these and other embodiments, the top opening and the bottom opening may be substantially perpendicular to the inlet nozzle of the outer component. In some embodiments, the outer component and the inner component may be arranged in a manner where there is selective communication between a coke drum and the top and bottom openings of the outer component. In these and other embodiments, the top opening and the bottom opening may be concentric circular openings, and at least one of a diameter of the top opening or a diameter of the bottom opening may be equal to or greater than a diameter of a manway to which one of the openings may be attached.

In some embodiments, the orifice of the inner component may have a diameter that is equal to or greater than a diameter of the top opening or the bottom opening of the outer component. In these and other embodiments, the outer component and the inner component may be arranged in a manner where there is selective communication between a coke drum and the orifice of the inner component. In some embodiments, the outer component and the inner component may be arranged in a manner where there is selective communication between a coke drum and the pipe elbow of the inner component.

In some embodiments, the inner component may be connected to a shaft (e.g., a moving shaft) of the actuator. In these and other embodiments, outer component may be connected to a body of the actuator. According to some embodiments, the pipe elbow of the inner component may be a 100° pipe elbow, a 95° pipe elbow, 90° pipe elbow, a 45° pipe elbow, or a 22° pipe elbow. In these and other embodiments, a first end of the pipe elbow may have a diameter that is the same or different than a diameter of a second end of the pipe elbow.

In operation, and according to some embodiments, a method of using the de-heading device 200 to, e.g., de-head a coke drum, can operate in the following manner. The method includes setting the de-heading device 200 to a closed (or partially closed) position by actuating an actuator 330. Actuation of the actuator 330 can cause the inner component 320 to slide into a position at which one end of the pipe elbow 322 of the inner component 320 aligns (or partially aligns) with the inlet nozzle 302 of the outer component 300. The method may further include coupling a feed (e.g., oil residue, steam, and/or water) to the inlet nozzle 302 of the outer component 300. The method may further include flowing a flow of steam through the inlet nozzle 302 and the pipe elbow 322 of the de-heading device 200 and into the coke drum 342. The flow of steam can serve, in part, to warm up the coke drum. The flow of steam can be ceased when the coke drum 342 reaches, e.g., a desired temperature. The method may further include flowing a flow of oil residue through the inlet nozzle 302 and the pipe elbow 322 of the de-heading device 200 and into the coke drum 342. The flow of oil residue can be ceased when the oil residue reaches, e.g., a maximum volume of oil residue in the coke drum 342. The method may further include flowing a second flow of steam through the inlet nozzle 302 and the pipe elbow 322 of the de-heading device 200 and into the coke drum 342. This second flow of steam can serve to steam-quench the coke bed in the coke drum 342. The second flow of steam can be ceased when, e.g., a desired volume of steam flows into the coke drum 342. The method may further include flowing a flow of water through the inlet nozzle 302 and the pipe elbow 322 of the de-heading device 200 and into the coke drum 342. This flow of water can serve to water-quench the coke bed in the coke drum 342. The flow of water can be ceased when the oil residue reaches, e.g., a maximum volume of water in the coke drum 342. Thus, and in some embodiments, the method may include filling the coke drum 342 with a material (e.g., steam, oil residue, and/or water) through an inlet nozzle 302 and a pipe elbow 322 of the de-heading device 200.

The method may further include setting the de-heading device 200 to an open (or partially open) position by actuating an actuator 330. Actuation of the actuator 330 can cause the inner component 320 to slide into a position at which the orifice 324 of the inner component 320 aligns (or partially aligns) with the top and bottom openings 304 of the outer component 300. When the de-heading device 200 is in an open position, any liquid (e.g., water) may drain out of the coke drum 342 and through the top and bottom openings 304 and the orifice 324 of the de-heading device 200. The method may further include cutting the solid coke and emptying the coke drum through the de-heading device 200. Typically, the coke drum 342 can be emptied into a large pit underneath the drum where the coke can be loaded onto, e.g., a conveyor belt, a truck, a container, or a train for shipping. Thus, in some embodiments, the method may further include removing a material (e.g., water, petroleum coke, gas, etc.) from the coke drum 342. The material that can be removed from the coke drum may be the same or different material that is used to fill the coke drum. In some embodiments, the method can include coupling (e.g., bolting) the de-heading device 200 to the coke drum 342. This coupling can be accomplished by use of a flange 344 (and/or a size adapter 346).

In operation, and according to some embodiments, a method of using the de-heading device 200 to, e.g., de-head a coke drum, can operate in the following manner. The method may include actuating an actuator for shifting between two or more positions (e.g., a closed position, or an open position), the actuator coupled to a de-heading device described herein. In some embodiments, the de-heading device can include an outer component comprising an inlet nozzle; and an inner component comprising a pipe elbow and an orifice, wherein the outer component is coupled to the inner component by the actuator. In these and other embodiments, the method may further include removing a material from a coke drum coupled to the de-heading device. The material may be removed by any method known to those skilled in the art, e.g., drilling, cutting, draining, emptying, and/or permitting the material exit the coke drum.

In operation, and according to some embodiments, a method of using the de-heading device 200 to, e.g., de-head a coke drum, can operate in the following manner. The method may include actuating an actuator for shifting between two or more positions, the actuator coupled to a de-heading device described herein. In some embodiments, the de-heading device can include an outer component comprising an inlet nozzle; and an inner component comprising a pipe elbow and an orifice, wherein the outer component is coupled to the inner component by the actuator. In these and other embodiments, the method may further include filling a coke drum coupled to the de-heading device with a material. Filling may be accomplished by any method known to those skilled in the art.

In operation, and according to some embodiments, a method of using the de-heading device 200 to, e.g., de-head a coke drum, can operate in the following manner. The method may include actuating an actuator to cause an inner component of a de-heading device to slide into a position at which an end of a pipe elbow of the inner component is substantially aligned with an inlet nozzle of an outer component, wherein the actuator is coupled to a de-heading device described herein. In some embodiments, the de-heading device can include the outer component having the inlet nozzle; and the inner component having the pipe elbow and an orifice, wherein the outer component is coupled to the inner component by the actuator. The method may further include flowing a first material through the inlet nozzle and the pipe elbow and into the coke drum, the coke drum coupled to the de-heading device. The method may further include actuating the actuator to cause the inner component of the de-heading device to slide into a position at which the orifice of the inner component is substantially aligned with a top opening on a top side of the outer component and a bottom opening on a bottom side of the outer component, wherein the top opening and the bottom opening are substantially perpendicular to the inlet nozzle. The method may further include allowing a second material to exit the coke drum and/or pass through the top and bottom openings and the orifice. The first material and the second material may be the same or different. In some embodiments, the flowing a material can include one or more of flowing steam through the inlet nozzle and the pipe elbow and into the coke drum, flowing oil residue through the inlet nozzle and the pipe elbow and into the coke drum, or flowing water through the inlet nozzle and the pipe elbow and into the coke drum.

Compared to conventional devices that use a separate valve and a retractable center feed, the de-heading device of the present disclosure is a single device and allows operators to purchase, install, and operate one device instead of two or more devices. This leads to, e.g., lower costs, faster installation times, less disruptions, and less maintenance compared to conventional devices and systems. Moreover, the de-heading device of the present disclosure operates completely outside of the coke drum. Therefore, there is no chance for the de-heading device to become stuck inside the drum as with conventional devices such as the retractable center feed devices. This leads to a much lower risk of unplanned shutdowns, repairs, and the associated costs.

Compared to conventional devices that use a separate valve and single (or dual) fixed side inlet nozzles that cause asymmetric flow of feed into the coke drum, the de-heading device of the present disclosure ensures symmetric flow of feed into the coke drum. The symmetric flow of the feed minimizes (or eliminates) damage to the drum by reducing thermal gradients. In addition, the symmetric flow of the feed minimizes (or eliminates) non-uniform processing of petroleum coke by reducing hot spots and blowouts.

Illustrative, non-exclusive examples of the subject matter according to the present disclosure are described in the following enumerated paragraphs:

A1. A de-heading device for a coke drum comprising an outer component comprising an inlet nozzle; and an inner component comprising a pipe elbow and an orifice, wherein the outer component is coupled to the inner component by an actuator, the actuator for shifting between two or more positions.

A2. The de-heading device of paragraph A1, wherein the outer component and the inner component are arranged in a manner where there is selective communication between a coke drum and the inlet nozzle.

A3. The de-heading device of paragraphs A1 or A2, wherein at least one position of the two or more positions allows a material to be introduced into the inlet nozzle and a coke drum.

A4. The de-heading device of any of paragraphs A1-A3, wherein at least one position of the two or more positions allows a material to exit a coke drum and/or to pass through the orifice of the inner component.

A5. The de-heading device of any of paragraphs A1-A4, wherein the outer component further comprises a top opening on a top side of the outer component, and a bottom opening on a bottom side of the outer component, and wherein the top opening and the bottom opening are substantially perpendicular to the inlet nozzle.

A6. The de-heading device of paragraph A5, wherein the outer component and the inner component are arranged in a manner where there is selective communication between a coke drum and the top and bottom openings of the outer component.

A7. The de-heading device of paragraphs A5 or A6, wherein the top opening and the bottom opening have concentric circular openings, and at least one of a diameter of the top opening or a diameter of the bottom opening is equal to or greater than a diameter of a coke drum bottom manway to which one of the openings is attached.

A8. The de-heading device of paragraph A7, wherein the orifice has a diameter that is equal to or greater than a diameter of the top opening or the bottom opening.

A9. The de-heading device of any of paragraphs A1-A8, wherein the outer component and the inner component are arranged in a manner where there is selective communication between a coke drum and the orifice of the inner component.

A10. The de-heading device of any of paragraphs A1-A9, wherein the outer component and the inner component are arranged in a manner where there is selective communication between a coke drum and the pipe elbow of the inner component.

A11. The de-heading device of any of paragraphs A1-A10, wherein the inner component is connected to a moving shaft of the actuator.

A12. The de-heading device of any of paragraphs A1-A11, wherein the outer component is connected to a body of the actuator.

A13. The de-heading device of any of paragraphs A1-A12, wherein the pipe elbow comprises a 100° pipe elbow, a 95° pipe elbow, 90° pipe elbow, a 45° pipe elbow, or a 22° pipe elbow.

A14. The de-heading device of any of paragraphs A1-A13, wherein a first end of the pipe elbow has a diameter that is the same or different than a diameter of a second end of the pipe elbow.

A15. The de-heading device of any of paragraphs A1-A14, wherein the de-heading device is coupled to a flange, a size adapter, or a combination thereof.

B1. A de-heading device for a coke drum comprising an outer component comprising an inlet nozzle, a top opening on a top side of the outer component, and a bottom opening on a bottom side of the outer component, wherein the top opening and the bottom opening are perpendicular to the inlet nozzle; and an inner component comprising a pipe elbow and an orifice, wherein the outer component is coupled to the inner component by an actuator, the actuator for shifting between two or more positions.

B2. The de-heading device of claim B1, wherein the outer component and the inner component are arranged in a manner where there is selective communication between a coke drum and the inlet nozzle.

B3. The de-heading device of paragraphs B1 or B2, wherein at least one position of the two or more positions allows a material to be introduced into the inlet nozzle and a coke drum.

B4. The de-heading device of any of paragraphs B1-B3, wherein at least one position of the two or more positions allows a material to exit a coke drum and/or to pass through the orifice of the inner component.

B5. The de-heading device of any of paragraphs B1-B4, wherein the outer component and the inner component are arranged in a manner where there is selective communication between a coke drum and the top and bottom openings of the outer component.

B6. The de-heading device of any of paragraphs B1-B5, wherein the top opening and the bottom opening have concentric circular openings, and at least one of a diameter of the top opening or a diameter of the bottom opening is equal to or greater than a diameter of a manway of a cone of a coke drum.

B7. The de-heading device of paragraph B6, wherein the orifice has a diameter that is equal to or greater than a diameter of the top opening or the bottom opening.

B8. The de-heading device of any of paragraphs B1-B7, wherein the outer component and the inner component are arranged in a manner where there is selective communication between a coke drum and the orifice of the inner component.

B9. The de-heading device of any of paragraphs B1-B8, wherein the outer component and the inner component are arranged in a manner where there is selective communication between a coke drum and the pipe elbow of the inner component.

B10. The de-heading device of any of paragraphs B1-B9, wherein the inner component is connected to a shaft of the actuator.

B11. The de-heading device of any of paragraphs B1-B10, wherein the outer component is connected to a body of the actuator.

B12. The de-heading device of any of paragraphs B1-B11, wherein the pipe elbow comprises a 100° pipe elbow, a 95° pipe elbow, a 90° pipe elbow, a 45° pipe elbow, or a 22° pipe elbow.

B13. The de-heading device of any of paragraphs B1-B12, wherein a first end of the pipe elbow has a diameter that is the same or different than a diameter of a second end of the pipe elbow.

B14. The de-heading device of any of paragraphs B1-B13, wherein the de-heading device is coupled to a flange, a size adapter, or a combination thereof.

C1. A de-heading device for a coke drum comprising an outer component comprising an inlet nozzle, a top opening on a top side of the outer component, and a bottom opening on a bottom side of the outer component, wherein the top opening and the bottom opening are perpendicular to the inlet nozzle; and an inner component comprising a pipe elbow and an orifice, wherein the outer component is coupled to the inner component by an actuator, the actuator for shifting between two or more positions, wherein at least one position of the two or more positions allows a material to be introduced into the inlet nozzle and a coke drum, and wherein at least one position of the two or more positions allows a material to exit a coke drum and/or to pass through the orifice of the inner component.

C2. The de-heading device of paragraph C1, wherein the outer component and the inner component are arranged in a manner where there is selective communication between a coke drum and the top and bottom openings of the outer component.

C3. The de-heading device of paragraphs C1 or C2, wherein the top opening and the bottom opening are concentric circular openings, and at least one of a diameter of the top opening or a diameter of the bottom opening is equal to or greater than a diameter of a manway of a cone of a coke drum.

C4. The de-heading device of any of paragraphs C1-C3, wherein the orifice has a diameter that is equal to or greater than a diameter of the top opening or the bottom opening.

C5. The de-heading device of any of paragraphs C1-C4, wherein the outer component and the inner component are arranged in a manner where there is selective communication between a coke drum and the orifice of the inner component.

C6. The de-heading device of any of paragraphs C1-C5, wherein the outer component and the inner component are arranged in a manner where there is selective communication between a coke drum and the pipe elbow of the inner component.

C7. The de-heading device of any of paragraphs C1-C6, wherein the inner component is connected to a moving shaft of the actuator.

C8. The de-heading device of any of paragraphs C1-C7, wherein the outer component is connected to a body of the actuator.

C9. The de-heading device of any of paragraphs C1-C8, wherein the pipe elbow comprises a 100° pipe elbow, a 95° pipe elbow, a 90° pipe elbow, a 45° pipe elbow, or a 22° pipe elbow.

C10. The de-heading device of any of paragraphs C1-C9, wherein a first end of the pipe elbow has a diameter that is the same or different than a diameter of a second end of the pipe elbow.

C11. The de-heading device of any of paragraphs C1-C10, wherein the de-heading device is coupled to a flange, a size adapter, or a combination thereof.

D1. A method of de-heading a coke drum comprising actuating an actuator, the actuator coupled to a de-heading device, wherein the de-heading device comprises an outer component comprising an inlet nozzle; and an inner component comprising a pipe elbow and an orifice, wherein the outer component is coupled to the inner component by the actuator, the actuator for shifting between two or more positions; and removing a material from a coke drum coupled to the de-heading device.

E1. A method of de-heading a coke drum comprising actuating an actuator, the actuator coupled to a de-heading device, wherein the de-heading device comprises an outer component comprising an inlet nozzle; and an inner component comprises a pipe elbow and an orifice, wherein the outer component is coupled to the inner component by the actuator, the actuator for shifting between two or more positions; and filling a coke drum coupled to the de-heading device with a material.

F1. A method of de-heading a coke drum comprising actuating an actuator to cause an inner component of a de-heading device to slide into a position at which an end of a pipe elbow of the inner component is substantially aligned with an inlet nozzle of an outer component, wherein the actuator is coupled to a de-heading device, and the de-heading device comprises the outer component having the inlet nozzle; and the inner component comprises the pipe elbow and an orifice, wherein the outer component is coupled to the inner component by the actuator.

F2. The method of paragraph F1, further comprising flowing a first material through the inlet nozzle and the pipe elbow and into a coke drum, the coke drum coupled to the de-heading device.

F3. The method of paragraphs F1 or F2, further comprising actuating the actuator to cause the inner component of the de-heading device to slide into a position at which the orifice of the inner component is substantially aligned with a top opening on a top side of the outer component and a bottom opening on a bottom side of the outer component, wherein the top opening and the bottom opening are substantially perpendicular to the inlet nozzle.

F4. The method of any of paragraphs F1-F3, further comprising allowing a second material to exit the coke drum and/or pass through the top and bottom openings and the orifice.

F5. The method of any of paragraphs F1-F4, wherein the flowing a material includes one or more of: flowing steam through the inlet nozzle and the pipe elbow and into the coke drum; flowing oil residue through the inlet nozzle and the pipe elbow and into the coke drum; or flowing water through the inlet nozzle and the pipe elbow and into the coke drum.

G1. A method of using the de-heading device of any of paragraphs A1-A15, B1-B14, and C1-C11.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

While the present disclosure has been described with respect to a number of embodiments and examples, those skilled in the art, having benefit of the present disclosure, will appreciate that other embodiments can be devised which do not depart from the scope and spirit of the present disclosure as described herein. Accordingly, it is not intended that the present disclosure be limited thereby. The term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "I" preceding the recitation of the composition, element, or elements and vice versa, e.g., the terms "comprising," "consisting essentially of," "consisting of" also include the product of the combinations of elements listed after the term.

What is claimed is:

1. A de-heading device for a coke drum, comprising:

an outer component comprising an inlet nozzle, a top opening, and a bottom opening;

an inner component disposed within the outer component, and comprising a support structure defining a cavity, the cavity containing a pipe elbow defining a first conduit and an orifice defining a second conduit; and an actuator configured to move the inner component between a first position in which a first end of the pipe elbow is substantially aligned with the inlet nozzle and a second end of the pipe elbow is substantially aligned with the top opening, and a second position in which the orifice is substantially aligned with the top and bottom openings.

2. The de-heading device of claim 1, wherein in operation, the outer component and the inner component are arranged in a manner where there is selective communication between the coke drum and the inlet nozzle.

3. The de-heading device of claim 1, wherein in operation, at least one position of the actuator allows a material to be introduced into the inlet nozzle and the coke drum.

4. The de-heading device of claim 1, wherein in operation, at least one position of the actuator allows a material to exit the coke drum and/or to pass through the orifice of the inner component.

5. The de-heading device of claim 1, wherein the top opening and the bottom opening are aligned substantially perpendicular to the inlet nozzle.

6. The de-heading device of claim 5, wherein in operation, the outer component and the inner component are arranged in a manner where there is selective communication between the coke drum and the top and bottom openings of the outer component.

7. The de-heading device of claim 5, wherein in operation, the top opening and the bottom opening have concentric circular openings, and at least one of a diameter of the top opening or a diameter of the bottom opening is equal to or greater than a diameter of a coke drum bottom manway to which one of the openings is attached.

8. The de-heading device of claim 1, wherein the inner component has a quadrilaterally-faced hexahedron topology or a rectangular cuboid topology.

9. The de-heading device of claim 1, wherein in operation, the outer component and the inner component are arranged in a manner where there is selective communication between the coke drum and the orifice of the inner component.

10. The de-heading device of claim 1, wherein in operation, the outer component and the inner component are arranged in a manner where there is selective communication between the coke drum and the pipe elbow of the inner component.

11. A de-heading device for a coke drum, comprising:

an outer component comprising an inlet nozzle, a top opening on a top side of the outer component, and a bottom opening on a bottom side of the outer component, wherein the top opening and the bottom opening are perpendicular to the inlet nozzle; and an inner component disposed within the outer component, and comprising a support structure defining a cavity, the cavity containing a pipe elbow defining a first conduit and an orifice defining a second conduit; and an actuator configured to move the inner component between a first position in which a first end of the pipe elbow is substantially aligned with the inlet nozzle and a second end of the pipe elbow is substantially aligned with the top opening, and a second position in which the orifice is substantially aligned with the top and bottom openings, and wherein the inlet nozzle extends in a direction substantially perpendicular to a direction of movement of the actuator.

12. The de-heading device of claim 11, wherein in operation, the outer component and the inner component are arranged in a manner where there is selective communication between the coke drum and the inlet nozzle.

13. The de-heading device of claim 11, wherein in operation, at least one position of the actuator allows a material to be introduced into the inlet nozzle and the coke drum.

14. The de-heading device of claim 11, wherein in operation, at least one position of the actuator allows a material to exit the coke drum and/or to pass through the orifice of the inner component.

15. The de-heading device of claim 11, wherein in operation, the outer component and the inner component are arranged in a manner where there is selective communication between the coke drum and the top and bottom openings of the outer component.

16. The de-heading device of claim 11, wherein the top opening and the bottom opening are concentric circular openings, and at least one of a diameter of the top opening or a diameter of the bottom opening is equal to or greater than a diameter of a manway of a cone of the coke drum.

17. The de-heading device of claim 11, wherein the inner component has a quadrilaterally-faced hexahedron topology or a rectangular cuboid topology.

18. The de-heading device of claim 11, wherein in operation, the outer component and the inner component are arranged in a manner where there is selective communication between the coke drum and the orifice of the inner component.

19. The de-heading device of claim 11, wherein in operation, the outer component and the inner component are arranged in a manner where there is selective communication between the coke drum and the pipe elbow of the inner component.

20. A method of de-heading a coke drum, comprising:

actuating an actuator for a first time, the actuator coupled to a de-heading device, wherein the de-heading device comprises:

an outer component comprising an inlet nozzle, a top opening, and a bottom opening; and an inner component disposed within the outer component, and comprising a support structure defining a cavity, the cavity containing a pipe elbow defining a first conduit and an orifice defining a second conduit;

wherein the actuator is configured to move the inner component between a first position in which a first end of the pipe elbow is substantially aligned with the inlet nozzle and a second end of the pipe elbow is substantially aligned with the top opening, and a second position in which the orifice is substantially aligned with the top and bottom openings;

removing a material from a coke drum coupled to the de-heading device;

actuating the actuator for a second time; and filling the coke drum coupled to the de-heading device with a material.

* * * * *